US008764519B2

(12) United States Patent
Michiyoshi

(10) Patent No.: US 8,764,519 B2
(45) Date of Patent: Jul. 1, 2014

(54) GRINDING WHEEL

(75) Inventor: Kazunori Michiyoshi, Toyama (JP)

(73) Assignee: Komatsu NTC Ltd., Toyama (JP)

( * ) Notice: Subject to any disclaimer, the term of this patent is extended or adjusted under 35 U.S.C. 154(b) by 0 days.

(21) Appl. No.: 13/992,098

(22) PCT Filed: Nov. 29, 2011

(86) PCT No.: PCT/JP2011/077523
§ 371 (c)(1),
(2), (4) Date: Jun. 6, 2013

(87) PCT Pub. No.: WO2012/077535
PCT Pub. Date: Jun. 14, 2012

(65) Prior Publication Data

US 2013/0260655 A1 Oct. 3, 2013

(30) Foreign Application Priority Data

Dec. 6, 2010 (JP) ..... 2010-271118

(51) Int. Cl.
*B24B 55/02* (2006.01)

(52) U.S. Cl.
USPC ..... 451/450; 451/488; 451/541

(58) Field of Classification Search
CPC ..... B24B 53/095; B23Q 11/10; B23D 59/02
USPC ..... 15/230.1; 451/450, 488, 541
See application file for complete search history.

(56) References Cited

U.S. PATENT DOCUMENTS

| | | | | | |
|---|---|---|---|---|---|
| 3,777,443 | A * | 12/1973 | Shaw | ..... | 451/543 |
| 5,423,717 | A * | 6/1995 | Boaz | ..... | 451/449 |
| 5,846,125 | A * | 12/1998 | Robichon | ..... | 451/450 |
| 2003/0114095 | A1 * | 6/2003 | Sauer | ..... | 451/488 |
| 2007/0259610 | A1 * | 11/2007 | Schrottner | ..... | 451/488 |
| 2012/0071072 | A1 * | 3/2012 | Cooper et al. | ..... | 451/488 |
| 2012/0288677 | A1 * | 11/2012 | Ishizu et al. | ..... | 428/141 |

FOREIGN PATENT DOCUMENTS

| | | | |
|---|---|---|---|
| JP | S62-110863 | U | 7/1987 |
| JP | H03-022862 | U | 3/1991 |
| JP | H04-063682 | A | 2/1992 |
| JP | H05-031674 | A | 2/1993 |
| JP | H06-023673 | A | 2/1994 |

OTHER PUBLICATIONS

International Search Report for corresponding patent application PCT/JP2011/077523; Japanese Patent Office, Dec. 27, 2011.

* cited by examiner

*Primary Examiner* — Timothy V Eley
(74) *Attorney, Agent, or Firm* — Capitol City TechLaw; Richard C. Irving

(57) ABSTRACT

A grinding wheel includes: a disc member; and an annular grindstone member fitted on an outer peripheral surface of the disc member, wherein the disc member has a fluid-supply hole formed therethrough from a first side surface to a second side surface thereof, wherein the fluid-supply hole has an outlet opening through an outer peripheral portion of the first side surface; and an inlet opening which is open through the second side surface and which is disposed at an inner position of the outlet opening in a radial direction of the disc member, and wherein the second side surface is formed with an outer peripheral wall which is disposed at an outer position of the inlet opening in a radial direction of the disc member and projects along an outer peripheral portion of the disc member.

3 Claims, 5 Drawing Sheets

GRINDING WHEEL

TECHNICAL FIELD

The invention relates to a grinding wheel which includes an annular grindstone member fitted to a disc member.

BACKGROUND ART

There is provided a grinding wheel for grinding a work surface, which has an annular grindstone member fitted on an outer peripheral surface of the disc member (see, for example, Patent Document 1).

This grinding wheel is enabled to grind the work surface while the grinding member is rotating about the center of the circle of the disc member and the outer peripheral surface is kept in contact with the work surface. If the work surface has a recessed shape, the work surface is ground by the side surface of the grindstone member.

PRIOR ART DOCUMENT

Patent Document

Patent Document 1
Patent Application Publication Laid-Open No. Hei 5-31674

SUMMARY OF INVENTION

Problem to be Solved by Invention

According to the above-described conventional grinding wheel, it is difficult for the grinding fluid to enter between the side surface of the grindstone member and the work surface. As a result, the temperature on the work surface excessively rises. Therefore, a lot of grinding fluid at a high pressure is sprayed between the side surface of the grindstone member and the work surface, which enables the grinding fluid to enter between the side surface of the grindstone member and the work surface. This, however, causes a problem that a large supply amount of grinding fluid is required and generation of mist increases.

The invention solves the above-described problem, and is directed to a grinding wheel which enables sufficient supply of the grinding fluid on the surface of the grindstone member and reduces a supply amount of grinding fluid and generation of mist.

Means for Solving Problem

To solve the problem, the invention provides a grinding wheel including: a disc member; and an annular grindstone member fitted on an outer peripheral surface of the disc member. The disc member has a fluid-supply hole formed therethrough from a first side surface to a second side surface thereof. The fluid-supply hole has an outlet opening through an outer peripheral portion of the first side surface; and an inlet opening which is open through the second side surface and is disposed at an inner position of the outlet opening in a radial direction of the disc member. The second side surface is formed with an outer peripheral wall which is disposed at an outer position of the inlet opening in the radial direction of the disc member and projects along an outer peripheral portion of the disc member.

To solve the problem, another aspect of the invention provides a grinding wheel including: a disc member; and an annular grindstone member fitted on an outer peripheral surface of the disc member. The disc member has a first fluid-supply hole and a second fluid-supply hole which are formed through the disc member from a first side surface to a second side surface of the disc member and which are formed alternately in a peripheral direction of the disc member. The first fluid-supply hole has an outlet opening through an outer peripheral portion of the first side surface; and an inlet opening which is open through the second side surface and is disposed at an inner position of the outlet opening in a radial direction of the disc member. The second fluid-supply hole has an outlet opening through an outer peripheral portion of the second side surface; and an inlet opening which is open through the first side surface and is disposed at an inner position of the outlet opening in a radial direction of the disc member. The first side surface and second side surface of the main body are formed with outer peripheral walls, respectively which are disposed at outer positions of inlet openings in a radial direction of the disc member and project along an outer peripheral portion of the disc member. Outlet openings are open through the outer peripheral walls, respectively.

To solve the problem, another aspect of the invention provides a grinding wheel including: a disc member; and an annular grindstone member projectingly provided at an outer peripheral portion on a first side surface of the disc member. The disc member is formed with a fluid-supply hole extending therethrough from the first side surface to a second side surface thereof. The fluid-supply hole has an outlet opening through an outer peripheral portion of the first side surface; and an inlet opening which is open through the second side surface and is disposed at an inner position of the outlet opening in a radial direction of the disc member. The second side surface is formed with an outer peripheral wall which is disposed at an outer position of the inlet opening in a radial direction of the disc member and projects along the outer peripheral portion of the disc member.

According to the aspects, while the grinding wheel is rotating about the center of the circle of the disc member, the grinding fluid is supplied onto the side surface of the disc member. The grinding fluid flows on the side surface outwardly in a radial direction under a centrifugal force, and is blocked on the outer peripheral wall. The grinding fluid, being reserved inside the outer peripheral wall, flows into the fluid-supply hole from the inlet opening disposed at an inner position of the outer peripheral wall to be jetted from the outlet opening of the opposite side surface to the outer peripheral portion of the disc member.

In this manner, the grinding fluid is jetted to the vicinity of the side surface of the grindstone member. When the side surface of the grindstone member grinds a work surface, the grinding fluid is sufficiently supplied onto the side surface of the grindstone member without supplying the grinding fluid at a high pressure, thereby remarkably reducing generation of mist.

The grinding fluid, being supplied onto the side surface of the disc member, is blocked on the outer peripheral wall and is guided to the inlet opening of the fluid-supply hole, thereby reducing a supply amount of the grinding fluid.

The fluid-supply hole is formed from the inlet opening to the outlet opening and in a straight-line in a radial direction of the disc member, thereby enabling the grinding fluid to smoothly flow through the fluid-supply hole.

In the grinding wheel, the inner peripheral surface on the outer peripheral wall is formed with an inclined surface of a reverse-taper which has a diameter decreased from a proximal end side to a distal end side thereof, and the side surface on the disc member and the inner peripheral surface on the outer peripheral wall form a recessed corner in a wedge shape. According to this construction, the outer peripheral wall securely blocks the grinding fluid and guides the grinding fluid to the inlet opening of the fluid-supply hole.

The above grinding wheel has a side surface formed with a recessed groove which is disposed at a position corresponding to the outlet opening and extends from an inner peripheral surface to an outer peripheral surface of the grindstone member. This side surface of the grindstone member enables the grinding fluid to be securely supplied, and the grinding fluid to be supplied onto the outer peripheral surface of the grindstone member through the recessed groove.

Advantageous Effects of Invention

The grinding wheel of the invention sufficiently supplies the grinding fluid onto the surface of the grindstone member, and remarkably reduces a supply amount of the grinding fluid and generation of mist.

BRIEF DESCRIPTION OF DRAWINGS

FIG. 2A is a sectional view taken along A-A in FIG. 1; and FIG. 2B is a sectional view taken along B-B in FIG. 1.

FIG. 3A is a sectional view of a construction in which both side surfaces of a grindstone member come in contact with a work surface; and FIG. 3B is a sectional view of a construction in which the corners of the grindstone member come in contact with the recessed corners of the work surface, respectively.

DESCRIPTION OF EMBODIMENTS FOR CARRYING OUT INVENTION

Figure 1:
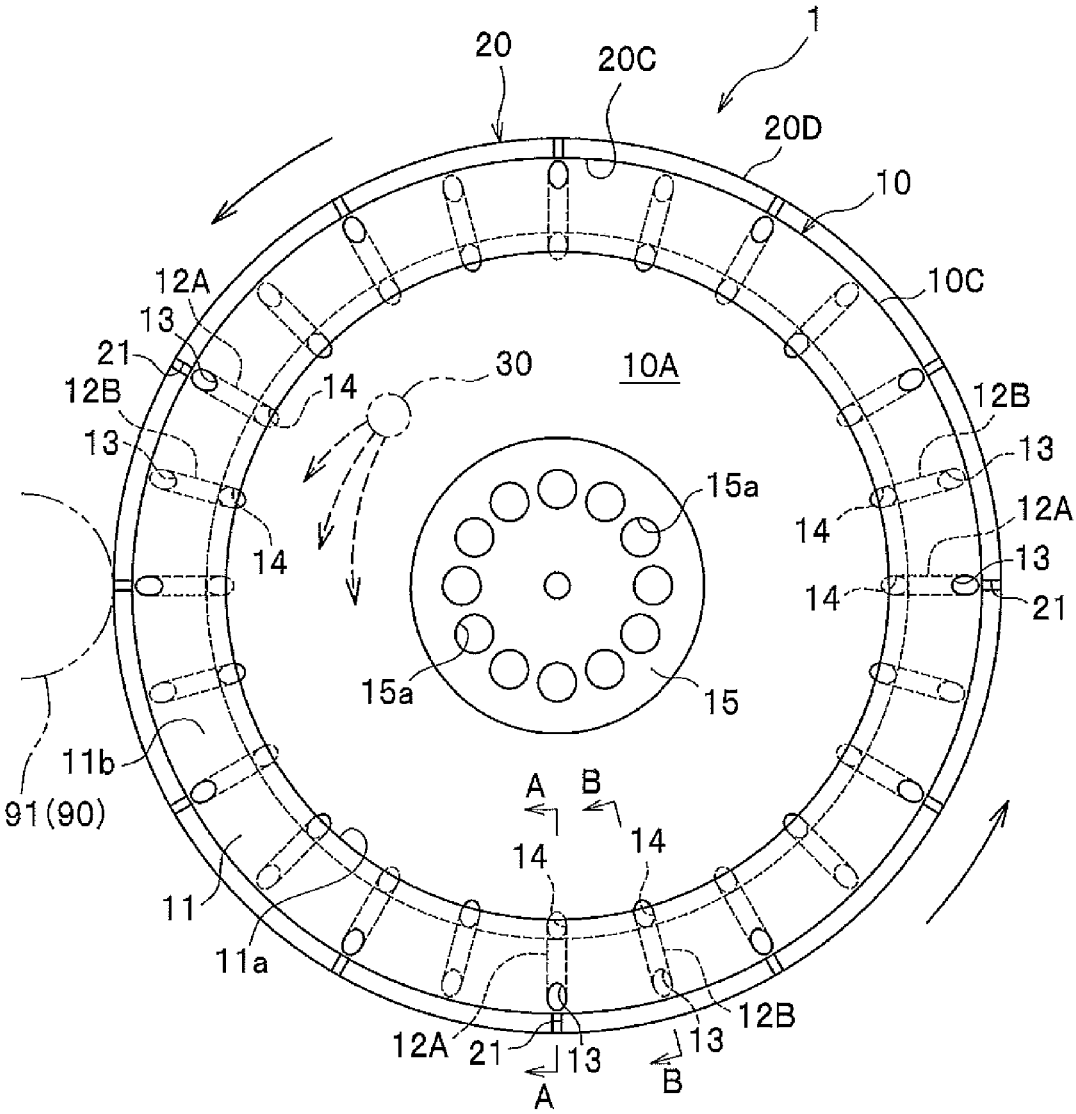
FIG. 1 is a side view showing a grinding wheel of a first embodiment.

The specific descriptions will be given of embodiments of the present invention by appropriately referring to the drawings.

Note that the same elements are attached with the same reference numerals in each description of embodiments, respectively, so as to omit redundant description.

[First Embodiment ]

A grinding wheel 1 of the first embodiment, as shown in FIG. 1, includes a disc member 10, and an annular grindstone member 20 fitted on the outer peripheral surface 10C of the disc member 10.

The disc member 10 has a center portion joined to a rotation shaft as not shown in the figures, and serves as a member to rotate about the center of the circle as a rotation center. This disc member 10 is a metal component as made of a steel material, and has a sufficient rigidity. The center portion of the disc member 10 is formed with a flanged surface 15 to which the tip surface of the rotation shaft is fixed. The flanged surface 15 defines fitting holes 15*a* in which bolts for fixing the disc member 10 and the rotation shaft to each other are inserted, respectively.

Figure 2B:
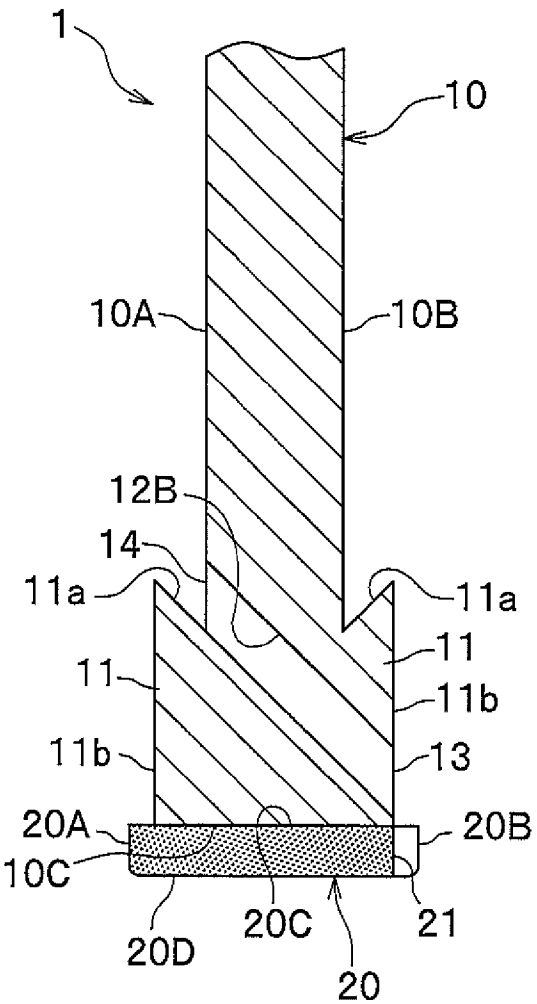
FIGS. 2A and 2B are views showing a grinding wheel of a first embodiment.
Figure 2A:
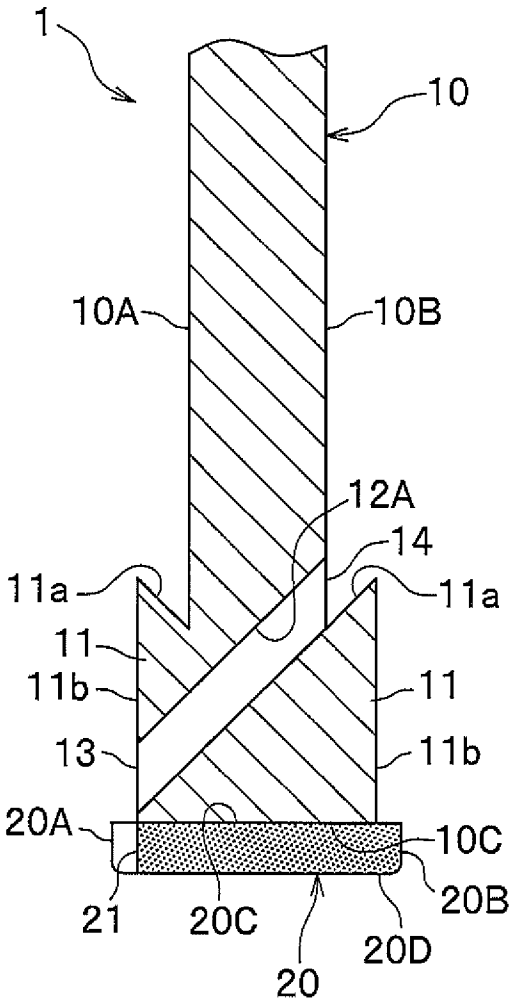

As shown in FIG. 2A, the disc member 10 has first and second side surfaces 10A, 10B with outer peripheries which are formed with outer peripheral walls 11, 11 projecting in normal directions (horizontal direction in FIG. 2A) relative to the side surfaces 10A, 10B, respectively.

Each outer peripheral wall 11 has an inner peripheral surface 11*a* that is an inclined surface of a reverse-taper having a diameter decreased from the proximal end side thereof (inside in a thickness direction) to the distal end side thereof (outside in a thickness direction). The side surfaces 10A, 10B of the disc member 10 and the inner peripheral surfaces 11*a* of the outer peripheral walls 11 form wedge-shaped recessed corners, respectively.

As shown in FIGS. 2A and 2B, the disc member 10 is formed with a first fluid-supply hole 12A and a second fluid-supply hole 12B having a circular section, which extend straight through the disc member 10 from the first side surface 10A to the second side surface 10B.

As shown in FIG. 1, first fluid-supply holes 12A and second fluid-supply holes 12B are formed at equal intervals in a peripheral direction of the disc member 10. The first fluid-supply holes 12A and the second fluid-supply holes 12B are alternately arranged in the peripheral direction.

The first fluid-supply hole 12A, as shown in FIG. 2A, is formed with an outlet opening 13 which is open through a side surface 11*b* on the outer peripheral wall 11 of a first side surface 10A. The first fluid-supply hole 12A is formed with an inlet opening 14 which is open through the second side surface 10B and disposed at an inner position of the outer peripheral wall 11 in a radial direction of the disc member 10.

The outlet opening 13 is open through the side surface 11*b* on the outer peripheral wall 11. The inlet opening 14 is open at the position adjacent to the inner peripheral surface 11*a* of the outer peripheral wall 11. Thus, the inlet opening 14 is disposed at an inner position of the outlet opening 13 in a radial direction of the disc member 10. Therefore, the first fluid-supply hole 12A is inclined to a width direction of the disc member 10 (horizontal direction of FIG. 2A). In the first embodiment, the inclined angle of the first fluid-supply hole 12A coincides with the inclined angle of the inner peripheral surface 11*a* of the outer peripheral wall 11.

The second fluid-supply hole 12B, as shown in FIG. 2B, is formed with an outlet opening 13 which is open through the side surface 11*b* on the outer peripheral wall 11 of the second side surface 10B. The second fluid-supply hole 12B is formed with an inlet opening 14 which is open through the first side surface 10A and is disposed at an inner position of the outer peripheral wall 11 in a radial direction of the disc member 10.

The second fluid-supply hole 12B is constructed such that the first fluid-supply hole 12A (see FIG. 2A) is reversed in a horizontal direction of FIG. 2A. Therefore, the second fluid-supply hole 12B, as well as the first fluid-supply hole 12A, is open through the side surface 11*b* on the outer peripheral wall 11 and is open at the position adjacent to the inner peripheral surface 11*a* on the outer peripheral wall 11. The inlet opening 14 is disposed at an inner position of the outlet opening 13 in a radial direction of the disc member 10.

The grindstone member 20, as shown in FIG. 1, is an annular grindstone. The first embodiment employs a grindstone of CBN (cubic boron nitride). On the other hand, the material is not limited to this, and the various known grindstones are also available. The grindstone member 20 has an inner peripheral surface 20C which is fixed on the outer peripheral surface 10C of the disc member 10.

As shown in FIG. 2A, the width of the grindstone member 20 is larger than the width of the outer peripheral surface 10C of the disc member 10. Therefore, the both side surfaces 20A, 20B of the grindstone member 20 project over both side surfaces 10A, 10B in a normal direction relative to both side surfaces 10A, 10B (horizontal direction of FIG. 2A), respectively.

As shown in FIG. 1, the grindstone member 20 has recessed grooves 21 at the positions corresponding to the outlet openings 13 on both side surfaces 20A, 20B (see FIG. 2B). The recessed grooves 21 in rectangular sections extend from the inner peripheral surface 20C to the outer peripheral surface 20D.

Figure 3B:
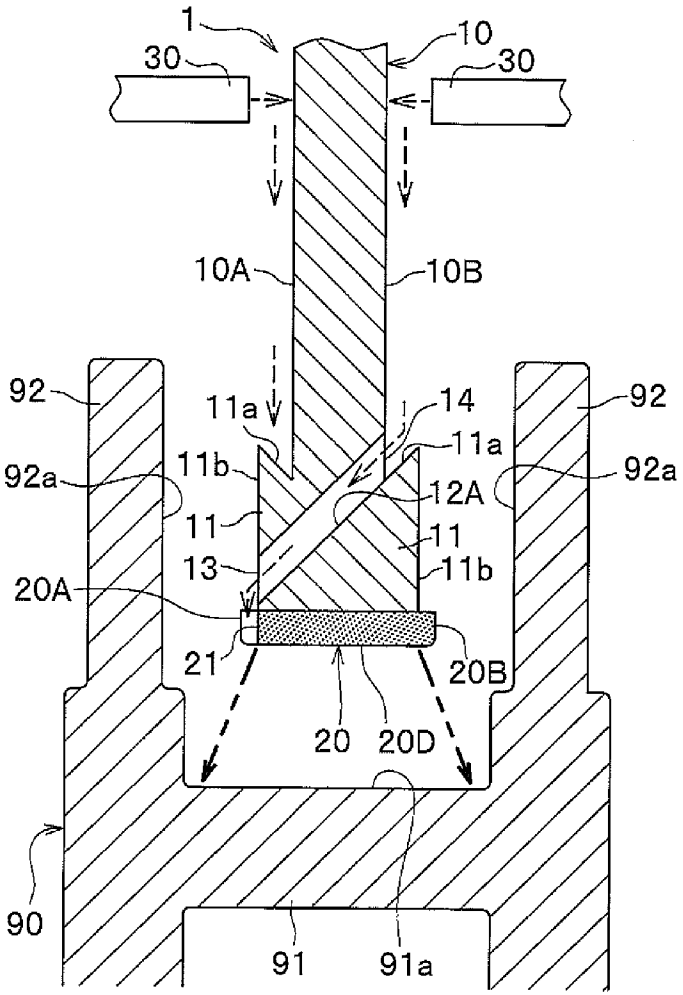
FIGS. 3A and 3B are views showing a grinding machining by use of the grinding wheel of the first embodiment.
Figure 3A:
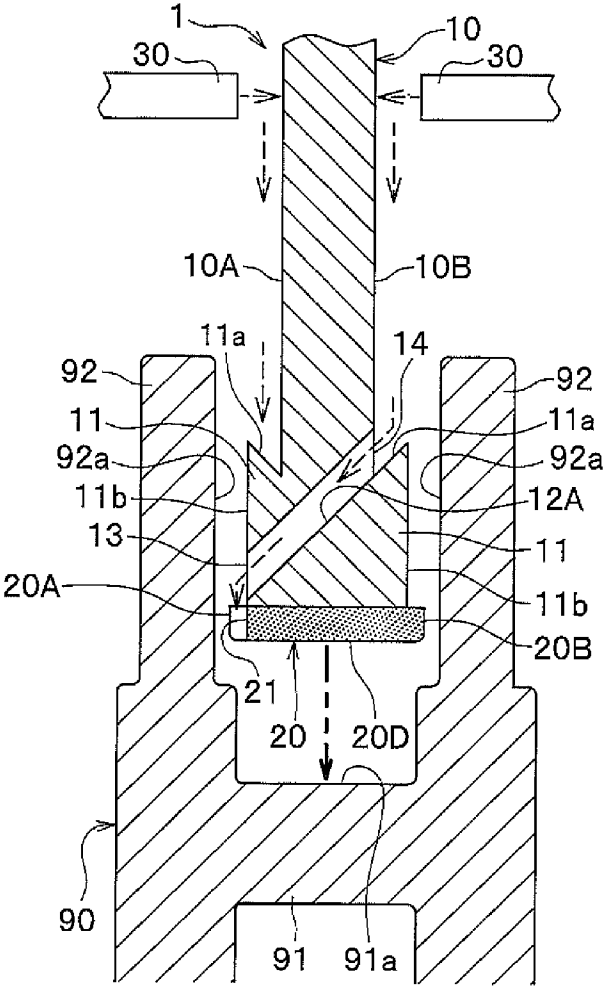

According to the above-constructed grinding wheel 1, as shown in FIG. 3A, the grinding fluid is jetted out of the fluid-supply nozzles 30, 30 vertically on both side surfaces 10A, 10B while the grinding wheel is rotating about the center of the circle of the disc member 10. Then, this fluid being jetted, to which a centrifugal force is applied, flows outward in a radial direction of the disc member 10, spreading on both side surfaces 10A, 10B in a peripheral direction of the disc member 10 (see FIG. 1).

It is noted that fluid-supply nozzles 30 are constructed so as to jet the grinding fluid on both side surfaces 10A, 10B at the upstream from the contact positions of the grinding wheel 1 and the work surface in a rotational direction.

The grinding fluid on both side surfaces 10A, 10B is blocked on the inner peripheral surfaces 11*a* of the peripheral walls 11 and is guided to the inlet opening 14 of the second side surface 10B to flow from the inlet opening 14 into the first fluid-supply hole 12A.

The grinding fluid flows through the first fluid-supply hole 12A to be jetted from the outlet opening 13 to the side surface 11*b* of the outer peripheral wall 11 to be supplied onto the side surface 20A of the grindstone member 20.

In the second fluid-supply hole 12B as shown in FIG. 2B, the grinding fluid flows from the inlet opening 14 of the first side surface 10A into the second fluid-supply hole 12B to be jetted from the outlet opening 13 of the second side surface 10B to the side surface 11*b* of the outer peripheral wall 11 to be supplied onto the side surface 20B of the grindstone member 20.

As shown in FIG. 3A, the grinding fluid, being jetted out of the outlet opening 13, flows into the recessed groove 21 formed on the side surface 20A (20B) of the grindstone member 20 to be supplied onto the outer peripheral surface 20D of the grindstone member 20 through the recessed groove 21.

The following description is given of the steps for grinding a crank shaft 90 by use of the grinding wheel 1 of the first embodiment.

To be specific, as shown in FIG. 3A, the grinding wheel 1 of the first embodiment grinds a recessed work surface which is constructed of the outer peripheral surface 91*a* of the crank journal 91 of the crank shaft 90; and the side surfaces 92*a*, 92*a* of the two crank webs 92, 92 formed at both ends of the crank journal 91.

While the grinding wheel 1 is rotating, the grinding fluid is jetted out of the fluid-supply nozzles 30, 30 on both side surfaces 10A, 10B of the disc member 10. The grinding fluid being jetted flows from the inlet openings 14 of both side surfaces 10A, 10B into the respective fluid-supply holes 12A, 12B (see FIG. 2B).

The grinding fluid flows through the respective fluid-supply holes 12A, 12B to be jetted from the outlet openings 13 on the opposite sides to be supplied onto both side surface 20A, 20B and the outer peripheral surface 20D.

Another nozzle (not shown in the figures) also jets grinding fluid on the outer peripheral surface 20D of the grindstone member 20.

These grinding fluids cool both side surfaces 20A, 20B and the outer peripheral surface 20D of the grindstone member 20.

While both side surfaces 20A, 20B of the grindstone member 20 are kept in contact with the side surfaces 92*a*, 92*a* of both crank webs 92, 92, the outer periphery of the grinding wheel 1 is inserted between both crank webs 92, 92 to grind the side surfaces 92*a*, 92*a* of both crank webs 92, 92. The outer peripheral surface 20D of the grindstone member 20 comes in contact with the outer peripheral surface 91 a of the crank journal 91 to grind the outer peripheral surface 91*a* of the crank journal 91.

It is noted, as shown in FIG. 3B, that if the interval between the side surfaces 92*a*, 92*a* of both crank webs 92, 92 is larger than the width of the grinding wheel 20, firstly, the horizontal corners of the grindstone member 20 come in contact with sequentially the horizontal recessed corners formed by the crank journal 91 and both crank webs 92, 92, respectively. Next, the outer peripheral surface 20D of the grindstone member 20 comes in contact with the outer peripheral surface 91*a* of the crank journal 91, and the grinding wheel 1 moves in an axial direction of the crank journal 91. Thus, grinding is performed on the side surfaces 92*a*, 92*a* of both crank webs 92, 92 and the outer peripheral surface 91*a* of the crank journal 91.

According to the above-described grinding wheel 1, as shown in FIG. 3A, the grinding fluid is jetted to the vicinity of both side surfaces 20A, 20B of the grindstone member 20. Therefore, if both side surfaces 20A, 20B of the grindstone member 20 grind the work surface even when the grinding fluid at a high pressure is not supplied, this fluid being jetted is enabled to be sufficiently supplied onto both side surfaces 20A, 20B of the grindstone member 20, thereby remarkably reducing generation of mist. No necessity to form the grindstone member 20 with a hole reduces the fabrication cost.

The grinding fluid, supplied onto both side surfaces 10A, 10B of the disc member 10, is blocked on the outer peripheral walls 11 and is guided to the inlet openings 14, 14 of the respective fluid-supply holes 12A, 12B. This guide enables the grinding fluid to securely flow into the respective fluid-supply holes 12A, 12B, which remarkably reduces a supply amount of the grinding fluid.

The respective fluid-supply holes 12A, 12B are formed in straight lines from the inlet openings 14 to the outlet openings 13 in radial directions of the disc member 10, and enable the grinding fluid to smoothly flow through respective fluid-supply holes 12A, 12B.

Though the above description is given of the first embodiment of the invention, the present invention is not limited to the first embodiment and is enabled to be properly modified without departing from the scope of the invention.

The number and the sizes of the first fluid-supply holes 12A and the second fluid-supply holes 12B as shown in FIG. 1 are not limited. Only one of the first fluid-supply hole 12A and second fluid-supply hole 12B may be formed in the disc member 10.

As shown in FIGS. 2A and 2B, the inner peripheral surfaces 11*a* of the outer peripheral walls 11 are inclined to the side surfaces 10A, 10B of the disc member 10 to form the wedge-shaped recessed corners, respectively. On the other hand, the inner peripheral surfaces 11*a* may be formed to be vertical to the side surfaces 10A, 10B, respectively, and the inclined angles are not limited. The side surfaces 10A, 10B and the inner peripheral surfaces 11*a* may form arc-shaped recessed corners, respectively.

Recessed grooves 21 of the grindstone member 20 as shown in FIG. 1 may not be required to be formed corresponding to all the outlet openings 13. The grindstone member 20 may not be formed with recessed grooves 21 on the side surfaces 20A, 20*b* of the grindstone member 20.

The number of the fluid-supply nozzles 30 is not limited. To enable the grinding fluid to sufficiently flow into the respective fluid-supply holes 12A, 12B, the number and arrangement of the fluid-supply nozzles 30 are set depending on the areas, the rotation speeds and the like of the side surfaces 10A, 10B of the grinding wheel 1.

[Second Embodiment ]

Figure 4:
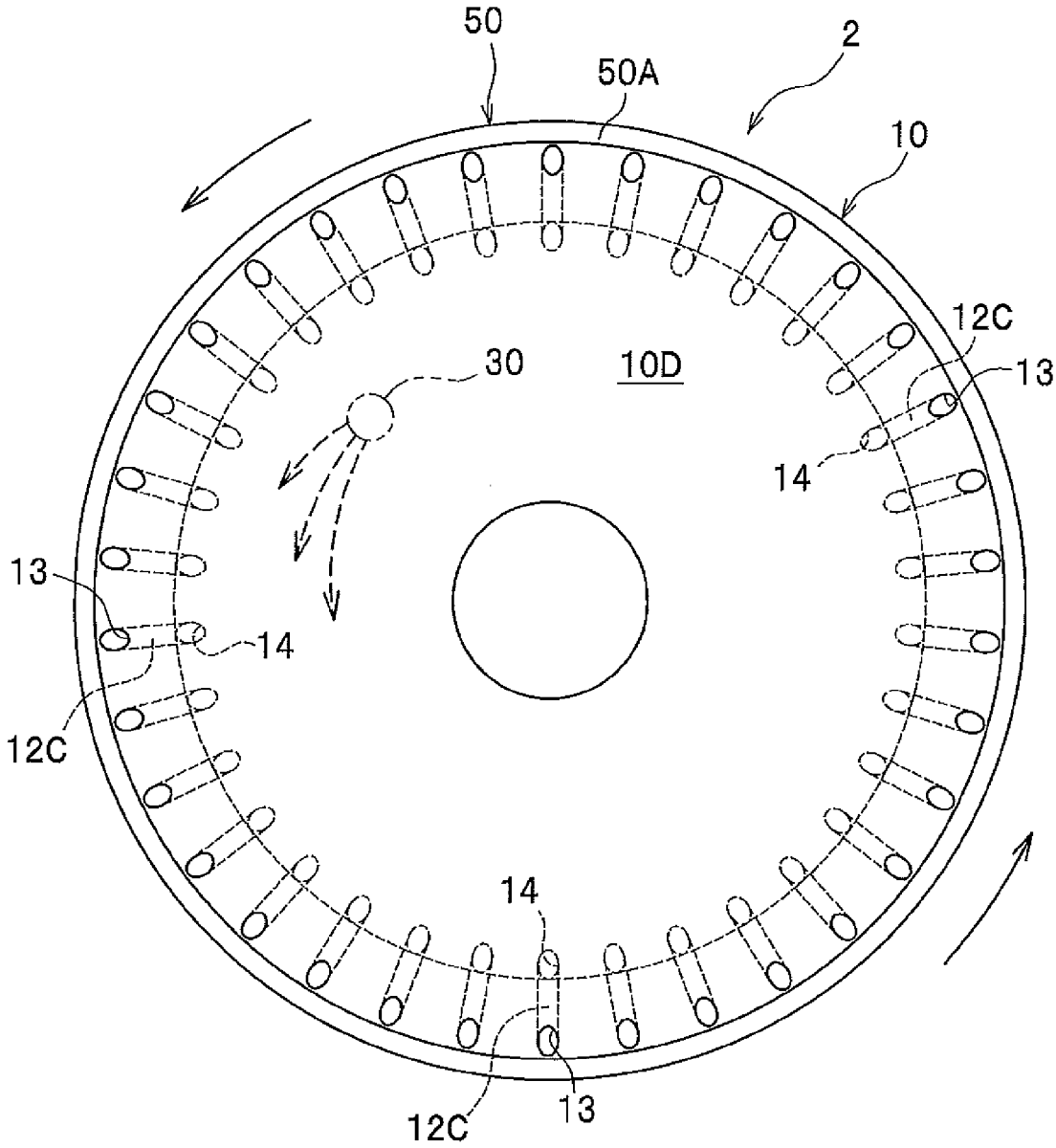
FIG. 4 is a bottom view of the grinding wheel of the second embodiment.

The grinding wheel 2 of the second embodiment, as shown in FIG. 4, differs from the grinding wheel 1 (see FIG. 2) of the first embodiment in that the disc member 10 is provided with an annular grindstone member 50 which projects from the outer peripheral portion on the bottom surface 10D. The grinding wheel 2 of the second embodiment, as shown in FIG. 5, grinds the top surface W1 of the grind-object component W.

The grinding wheel 2 of the second embodiment, as shown in FIG. 4, has fluid-supply holes 12C formed at equal intervals in a peripheral direction of the disc member 10. The fluid-supply holes 12C have outlet openings 13 open through the bottom surface 10D and inlet openings 14 open through the top surface 10E. The inlet openings 14 are disposed at inner positions of the outlet openings 13 in radial directions of the disc member 10, respectively.

Figure 5:
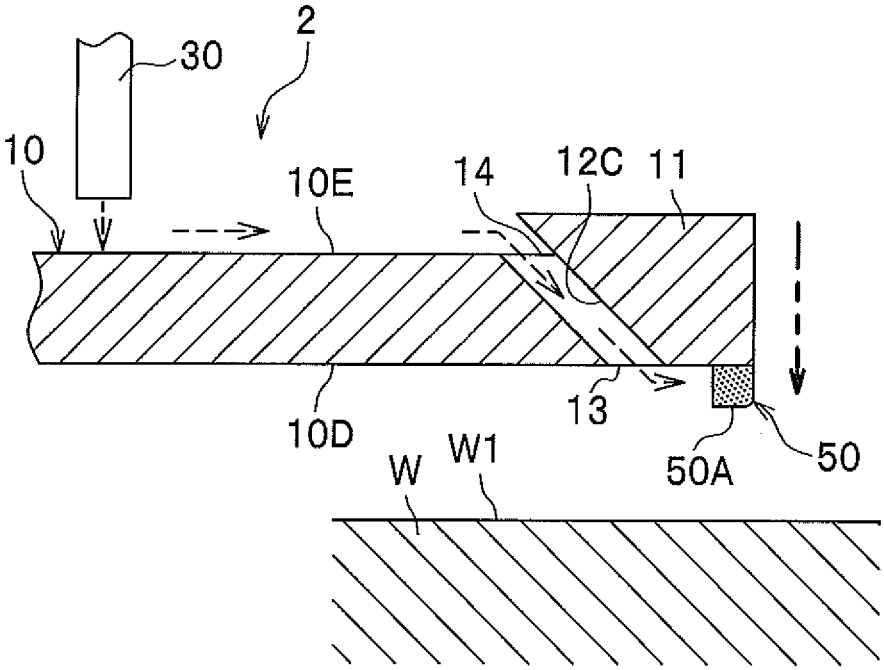
FIG. 5 is a side sectional view showing a grinding wheel of the second embodiment.

The grinding wheel 2 of the second embodiment is used to grind the grind-object component W as shown in FIG. 5. That is, while the grinding wheel 2 is rotating, the grinding fluid is jetted out of the fluid-supply nozzle 30 onto the top surface 10E of the disc member 10. The grinding fluid being jetted flows from the inlet openings 14 of the top surface 10E into the fluid-supply holes 12C.

The grinding fluid flows through the fluid-supply holes 12C to be jetted out of the outlet opening 13. Then, the grinding fluid is supplied onto the bottom surface 50A and both side surfaces 50B of the grindstone member 50. The bottom surface 50A on the grindstone member 50 comes in contact with the top surface W1 to grind the top surface W1.

According to the grinding wheel 2 of the above-described second embodiment, the grinding fluid is jetted to the vicinity of the grindstone member 50, and is enabled to be sufficiently supplied onto the bottom surface 50A of the grindstone member 50.

The grinding fluid, being supplied onto the top surface 10E of the disc member 10, is blocked on the outer peripheral wall 11 and is guided to the inlet openings 14 of the fluid-supply holes 12C. This guide enables the grinding fluid to securely flow into the respective fluid-supply holes 12C, which remarkably reduces a supply amount of the grinding fluid.

DESCRIPTION OF REFERENCE NUMERALS

1 grinding wheel (first embodiment)
2 grinding wheel (second embodiment)
10 disc member
10A first side surface (disc member)
10B second side surface (disc member)
10C outer peripheral surface (disc member)
11 outer peripheral wall
11*a* inner peripheral surface (outer peripheral wall)
11*b* side surface (outer peripheral wall)
12A first fluid-supply hole
12B second fluid-supply hole
13 outlet opening
14 inlet opening
20 grindstone member
20A side surface (grindstone member)
20B side surface (grindstone member)
20D outer peripheral surface (grindstone member)
21 recessed groove
30 fluid-supply nozzle
90 crank shaft
91 crank journal
92 crank web

The invention claimed is:

1. A grinding wheel comprising:

a disc member; and an annular grindstone member fitted on an outer peripheral surface of the disc member, wherein the disc member has a first fluid-supply hole and a second fluid-supply hole which are formed through the disc member from a first side surface to a second side surface of the disc member and which are formed alternately in a peripheral direction of the disc member, wherein the first fluid-supply hole has an outlet opening through an outer peripheral portion of the first side surface, and an inlet opening which is open through the second side surface and is disposed at an inner position of the outlet opening in a radial direction of the disc member, wherein the second fluid-supply hole has an outlet opening through an outer peripheral portion of the second side surface, and an inlet opening which is open through the first side surface and is disposed at an inner position of the outlet opening of the second fluid-supply hole in a radial direction of the disc member, wherein the first side surface and the second side surface of the disc member are formed with outer peripheral walls, respectively which are disposed at outer positions of inlet openings in a radial direction of the disc member and which project along an outer peripheral portion of the disc member, and wherein outlet openings are open through the outer peripheral walls, respectively.

2. The grinding wheel according to claim 1, wherein each of the outer peripheral walls has an inner peripheral surface that is an inclined surface having a diameter decreased from a proximal end side thereof to a distal end side thereof.

3. The grinding wheel according to claim 1, wherein the grindstone member has a side surface formed with a recessed groove which is disposed at a position corresponding to one of the outlet openings and extends from an inner peripheral surface to an outer peripheral surface of the grindstone member.

* * * * *